United States Patent [19]

Kameda

[11] 4,289,299

[45] Sep. 15, 1981

[54] HYDRAULIC LIFTING JACK INCLUDING A SAFETY DEVICE FOR AN ELEVATOR THEREIN

[75] Inventor: Tamotsu Kameda, Fujinomiya, Japan

[73] Assignee: Yasui Sangyo Co., Ltd., Fujinomiya, Japan

[21] Appl. No.: 108,644

[22] Filed: Dec. 31, 1979

[51] Int. Cl.[3] ..... B66F 5/04

[52] U.S. Cl. ..... 254/8 B

[58] Field of Search ..... 254/2 B, 8 B, 124

[56] References Cited

U.S. PATENT DOCUMENTS 1,738,622 12/1929 Weaver et al. ..... 254/2 B

FOREIGN PATENT DOCUMENTS 1248261 9/1971 United Kingdom ..... 254/8 B

*Primary Examiner*—Robert C. Watson

*Attorney, Agent, or Firm*—Lackenbach, Lilling & Siegel

[57] ABSTRACT

A hydraulic lifting jack on wheels, comprising a pair of frame plates, an elevator pivotally mounted on the frame plates, a lifting saddle arranged in the free end of the elevator, and a hydraulic power unit for lifting the elevator, in which a safety device for the elevator is further provided and comprises a support block member pivotally mounted to the elevator, and step block members, each having stop steps in its front slope surface, secured to the frame plates. The support block member is pivoted by a lever into an engaging or disengaging position wherein the support block member engages or disengages with or from the step block members. When the support block member is positioned in the engaged position, the raised elevator is prevented from falling down by the support block member, the bottom of which is supported by the stop steps of the step block members.

2 Claims, 3 Drawing Figures

HYDRAULIC LIFTING JACK INCLUDING A SAFETY DEVICE FOR AN ELEVATOR THEREIN

BACKGROUND OF THE INVENTION

This invention relates to a hydraulic lifting jack including a safety device for an elevator therein.

With a conventional lifting jack, most accidents happens when elevator of the lifting jack fails or accidentally rides down, which is very dangerous. Further, when an operator operates a wrong lever by mistake, the elevator of the lifting jack goes down against his, which will often bring about the same fatal results.

SUMMARY OF THE INVENTION

It is an object of the present invention to provide a hydraulic lifting jack including a safety device for an elevator therein free from the aforementioned disadvantages, and one which is simple in construction and reliable and safe in operation.

According to the present invention there is provided a hydraulic lifting jack on wheels, comprising: a pair of frame plates; an elevator which is pivotally mounted to the frame plates; a lifting saddle arranged in the free end of the elevator; and a hydraulic power unit, mounted to the frame plates, for lifting the elevator. The safety device for the elevator, comprising a support block means which is pivotally mounted to the elevator, and a step block means having stop steps in its front slope surface, which is secured to the frame plates, wherein the support block means is adapted to be pivoted into an engaging or disengaging position wherein the support block means engages or disengages with or from the step block means, and wherein, when the support block means is positioned in the engaged position, the raised elevator is prevented from falling down by the support block means the bottom of which is supported by the stop steps of the step block means.

DESCRIPTION OF THE DRAWINGS

In order that the present invention may be better understood, a preferred embodiment thereof will now be described with reference to the accompanying drawings, in which.

DESCRIPTION OF THE PREFERRED EMBODIMENT

Figure 1:
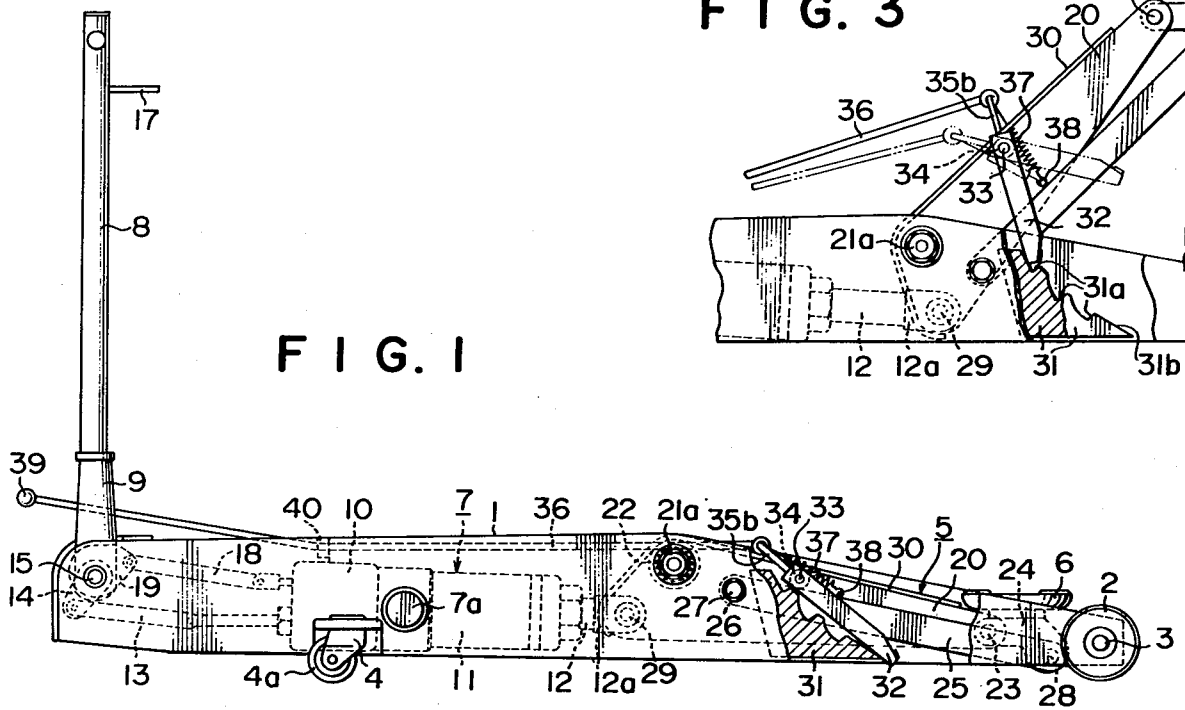
FIG. 1 is a side view of a hydraulic lifting jack including a safety device for an elevator therein made in accordance with the present invention.
Figure 2:
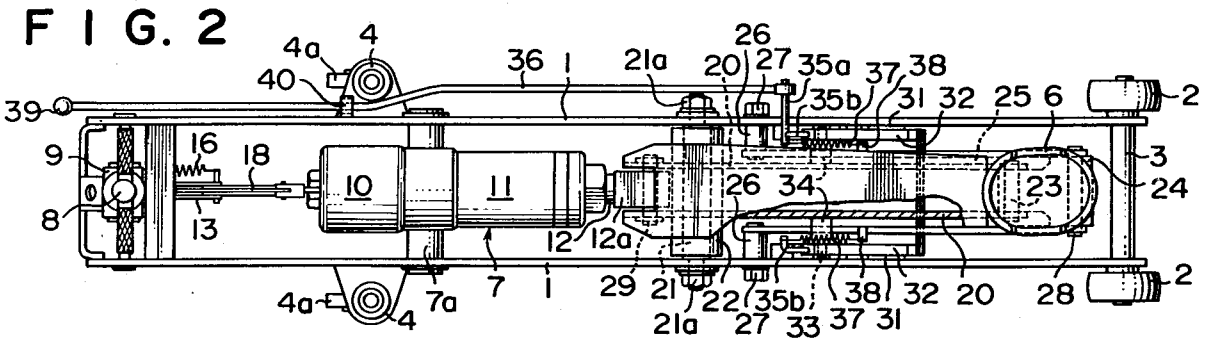
FIG. 2 is a top plan view of the lifting jack shown in FIG. 1.

Referring now to the drawings, in which the same numerals denote the same parts, there is shown in FIGS. 1 and 2 a hydraulic lifting jack comprising a pair of frame plates 1; a pair of front wheels 2 which are rotatably mounted to the frame plates 1 through a shaft 3; a pair of casters 4 with rear wheels 4*a*, mounted to the rearward portions of the frame plates 1; an elevator 5, pivotally mounted to the frame plates 1, for lifting an object; a lifting saddle 6 arranged in the free end of the elevator 5; a hydraulic power unit 7 for lifting the elevator 5, which is mounted to the frame plates 1 by a mounting member 7*a;* and a handle 8 including a handle rod for lowering the elevator 5, which is mounted to the frame plates 1 in its end portion by a yoke 9.

The hydraulic power unit 7 is of substantially conventional construction and comprises an oil pump means 10 actuated by the handle 8, an oil cylinder 11 connected thereto, and an actuating rod 12 connected thereto. When the elevator 5 is raised, the handle 8 is turned up and down many times for actuating the oil pump means 10 via a coupling rod 13 and a link 14, and thereby pushing the oil cylinder 11. Then, the actuating rod 12 is extended forwards, i.e. the right hand side direction in FIG. 1, by the oil cylinder 11, and thereby the elevator 5 coupled to the actuating rod 12 is raised, as hereinafter described.

When the elevator is lowered, a lever 17 connected to the handle rod of the handle 8 is pivoted in a horizontal plane, and then a cam plate 19 which is engaged with the lower end of the handle rod is rotated counterclockwise in FIG. 1 around a shaft 15. Then, a coupling rod 18 connected to the cam plate 19 is pulled in the left hand side direction, and thus the by-pass of the oil pump means 10 is opened, with the result that the actuating rod 12 is retreated or withdrawn while the elevator 5 is lowered.

The elevator 5 is of substantially conventional construction and comprises two elevator arms 20 of which the upper parts of one end portions are connected to a pivot member 22 on a pivot shaft 21 which is pivotally mounted to the frame plates 1 by nuts 21*a*, and the other ends of which are pivotally mounted to a bracket 24 of the saddle 6 via pivot pins 23, and a pair of link bars 25, one ends of which are pivotally connected to the frame plates 1 via pivot pins 26 by nuts 27, and the other ends of which are pivotally mounted to the bracket 24 via pivot pins 28. The tops of the elevator arms 20 are covered by a cover plate 30.

To the one ends of the elevator arms 20 is secured a link shaft 29 which is pivotally coupled to the front end portion 12*a* of the actuating rod 12.

While the elevator 5 is raised by the forward movement of the actuating rod 12, the lifting saddle 6 is always kept horizontal by a parallelogram link mechanism with four vertexes, i.e. the pivot shaft 21 and the pivot pins 23, 26 and 28.

Figure 3:
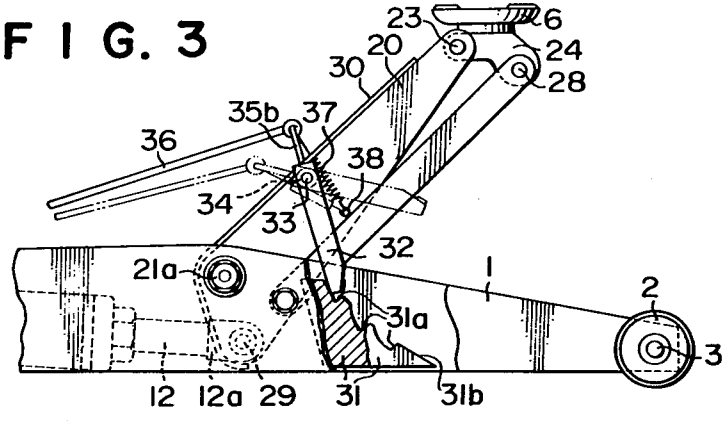
FIG. 3 is a fragmentary view showing the safety device of the lifting jack in FIG. 1, when the elevator is lifted.

As clearly shown in FIG. 3, a safety device for the elevator 5 comprises a pair of step block members 31, each having hollow stop steps 31*a* in its inclined front surface and a lower slope 31*b* in its foot, secured to the frame plates 1, and a support block member 32 pivotally mounted to the elevator arms 20 via bosses 34 secured thereto by pivot pins 33. To the top of the support block member are connected a horizontal rod 35*a* extending outwards via a short rod 35*c* in its one side and a bend rod 35*b* having a bent in its free end, in its the other side.

A pair of springs 37 are disposed between the horizontal rod 35*a*, the top of the bend rod 35*b*, and the stop pins 38 mounted to the link bars 25. The outer end of the horizontal rod 35*a* is pivotally connected to one end of a coupling rod 36 the other end of which is connected to an actuating lever 39 through a hole of a guide member 40 mounted to the frame plate.

When the lever 39 is pushed, the safety device is operated, that is, the support block member 32 is pivoted clockwise about the pivot pin 33 as shown in FIG. 3 against the springs 37 and into an engaged position wherein the lower end portion of the support block members 32 is engaged with the step block members 31 by the springs 37, as clearly shown by the solid lines in FIG. 3.

Meanwhile, when the lever 39 is pulled, the safety device does not work, that is, the support block member 32 is pivoted counterclockwise about the pivot pin 33 as shown in FIG. 3 against the springs 37 through a dead point, i.e. the stop pins 38, into a disengaged position wherein the lower end portion of the support block member 32 is disengaged from the step block members 31 by the springs 37, as clearly shown by the two-dotted lines in FIG. 3.

As the elevator 5 is lifted from the bottom while the safety device is operated, the bottom of the support block member 32 is raised from the ground upwardly along the front surfaces of the step block members 31 in contact with their lower slopes 31*a* and then their stop steps 31*a*.

When the raised elevator 5 is suddenly lowered by an accident, a mistake of operation, or the like, the fall downward of the elevator 5 is stopped by the support block member 32, the bottom of which is stopped by the stop steps 31*a* of the step block members 31.

When the elevator is lowered, the bottom of the support block member 32 is pivoted upwards away from the step block members 31 by pulling the lever 39, as described above.

Although the present invention has been described in some detail by way of illustration and example for purposes of clarity of understanding, it will, of course, be understood that various changes and modifications may be made in the form, details, and arrangements of the parts without departing from the scope of the invention as set forth in the following claims.

What is claimed is:

1. A lifting jack having a pair of frame plates, with an elevator pivotally mounted to said pair of frame plates; and having a lifting saddle arranged at the free end of said elevator; and a power unit, mounted to said pair of frame plates, for lifting said elevator, and comprising: a safety device for the elevator including support block means pivotally mounted to said elevator, step block means having a front slope surface and a plurality of stop steps in said front slope surface, and said step block means being secured to said pair of frame plates; a lever coupled to said support block means, and spring means; said lever being adapted to move said support block means between an engaging position wherein said support block means engages with said step block means and a disengaging position wherein said support block means is disengaged from said step block means, and said spring means being adapted to retain said support block means in either the engaged position or the disengaged position in such a manner that in being moved between the engaged and disengaged positions, said support block passes through a dead point, whereby should said elevator fall, the engagement of said support block means with said step block means prevents the collapse of the lifting jack.

2. The lifting jack according to claim 1, wherein said step block means comprises a pair of step block members secured to the inside surfaces of said pair of frame plates.

* * * * *